US011198956B2

(12) United States Patent
Bungter et al.

(10) Patent No.: US 11,198,956 B2
(45) **Date of Patent: *Dec. 14, 2021**

(54) MULTIPOINT TEXTILE MACHINE

(71) Applicant: Saurer Spinning Solutions GmbH & Co. KG, Übach-Palenberg (DE)

(72) Inventors: Stefan Bungter, Wegberg (DE); Jochen Cüppers, Mönchengladbach (DE); Marc Küppenbender, Mönchengladbach (DE); Christian Vierschgens, Geilenkirchen (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/286,244

(22) Filed: Feb. 26, 2019

(65) Prior Publication Data

US 2019/0194835 A1 Jun. 27, 2019

Related U.S. Application Data

(63) Continuation of application No. 14/953,540, filed on Nov. 30, 2015, now Pat. No. 10,337,127.

(30) Foreign Application Priority Data

Dec. 13, 2014 (DE) ..... 102014018628.8

(51) Int. Cl.
*D01H 13/22* (2006.01)
*B65H 54/26* (2006.01)
(Continued)

(52) U.S. Cl.
CPC ..... *D01H 13/22* (2013.01); *B65H 54/26* (2013.01); *B65H 54/70* (2013.01); *B65H 63/00* (2013.01); *D01H 13/14* (2013.01); *B65H 2701/31* (2013.01)

(58) Field of Classification Search
CPC ..... D01H 13/22; D01H 13/14
(Continued)

(56) References Cited

U.S. PATENT DOCUMENTS 4,631,930 A 12/1986 Gutschmit et al.
5,323,625 A 6/1994 Paggiaro
(Continued)

FOREIGN PATENT DOCUMENTS

DE 3406215 A1 8/1985
DE 199 29 467 A1 12/2000
(Continued)

OTHER PUBLICATIONS

European Search Report for corresponding European Patent Application No. 15003240.7 dated Apr. 29, 2016; all enclosed pages cited.

*Primary Examiner* — Jong-Suk (James) Lee
*Assistant Examiner* — Eric T Eide
(74) *Attorney, Agent, or Firm* — Nelson Mullins Riley & Scarborough LLP

(57) ABSTRACT

A textile machine with a plurality of similar workstations as well as display means and a central control device, wherein the display means is connected to the central control device and/or a workstation control device. The textile machine comprises a display means, which is designed as an LED light bar, a section of the LED light bar is assigned respectively to a workstation, and the LED light bar displays the respectively produced yarn batch and/or operating states of the respective workstation.

6 Claims, 5 Drawing Sheets

(51) Int. Cl.
*B65H 54/70* (2006.01)
*B65H 63/00* (2006.01)
*D01H 13/14* (2006.01)

(58) Field of Classification Search
USPC ..... 60/1
See application file for complete search history.

(56) References Cited

U.S. PATENT DOCUMENTS

| | | | | |
|---|---|---|---|---|
| 5,347,449 | A | 9/1994 | Meyer et al. | |
| 5,799,476 | A | 9/1998 | Bahlmann | |
| 5,857,637 | A * | 1/1999 | Straaten | B65H 54/26 242/473.7 |
| 6,014,592 | A * | 1/2000 | Fechter | B65H 54/26 242/157.1 |
| 6,328,247 | B1 | 12/2001 | Fechter et al. | |
| 6,556,885 | B2 * | 4/2003 | Hosel | D01G 31/00 112/155 |
| 7,377,094 | B2 | 5/2008 | Grecksch et al. | |
| 7,406,750 | B2 | 8/2008 | Hosel | |
| 2003/0064646 | A1 | 4/2003 | Brown et al. | |
| 2005/0083322 | A1 | 4/2005 | Hosel | |
| 2007/0028585 | A1 | 2/2007 | Grecksch et al. | |

FOREIGN PATENT DOCUMENTS

| | | | |
|---|---|---|---|
| DE | 199 30 714 | A1 | 1/2001 |
| DE | 103 49 266 | A1 | 5/2005 |
| DE | 10 2006 045 237 | A1 | 4/2008 |
| DE | 10 2008 003 704 | A1 | 7/2009 |
| EP | 0 115 537 | A1 | 8/1984 |
| EP | 1 347 233 | A2 | 9/2003 |
| EP | 2 166 137 | A1 | 3/2010 |
| EP | 2 762 617 | A1 | 8/2014 |

* cited by examiner

MULTIPOINT TEXTILE MACHINE

CROSS-REFERENCE TO RELATED APPLICATIONS

This application is a continuation application claiming priority from U.S. patent application Ser. No. 14/953,540, filed on Nov. 30, 2015, which claims priority from German National Patent Application No. 10 2014 018 628.8, filed Dec. 13, 2014, entitled "Vielstellentextilmaschine", the entire contents of which are incorporated herein by reference.

FIELD OF THE INVENTION

The invention relates to a textile machine with a plurality of similar workstations as well as display means and a central control device, wherein the display means are connected to the central control device and/or a workstation control device.

BACKGROUND OF THE INVENTION

In principle, it is known to provide optical displays on the workstations of textile machines comprising a plurality of similar workstations, which display operating states and/or equip the workstations with a device which makes it possible to query the operating status of the workstation at the touch of a button.

Often devices are used or expanded for the display means which are already available in the textile machine, such as for example the yarn cleaner or the signal lights, which are arranged to be clearly visible via the workstations.

Said displays are designed to support the operating staff responsible for the correct operation of such multipoint textile machines. Operating staff cannot always recognize whether or not a workstation is producing, particularly from a distance or if there is fault for example. This means that operating staff often have to walk unnecessary distances or the workstations are at rest for longer than absolutely necessary.

Rapid intervention is extremely important as idle or low quality producing workstations result in a loss of production or a lower yield.

For example, it is known from German Patent Document DE 10 2006 045 237 A1 for example, to arrange a display on winding machines in the lining of each winding station, which indicates the type of fault and/or the location of the fault. For this the display is designed such that it includes several light-permeable individual images of possible faults and/or sites of faults, to which a light sources is assigned respectively, which can be controlled individually by the workstation computer. In this way it is easier for the operating staff to identify the type and location of the fault and to take the necessary corrective measures.

German Patent Document DE 10 2008 003 704 A1 discloses a method or a workstation of a semi-automatic open end spinning machine, which provides optimal support for the operating staff during operation, in particular with regard to the correct cross wound bobbin/empty sleeve exchange. In addition, each of the numerous workstations comprises a signal device which can be noticed by an operator even at a distance, which at the end of the bobbin journey of a cross wound bobbin displays that a predefinable thread length has been reached. To ensure that the operating staff can identify early that a cross wound bobbin/empty sleeve change is necessary, a flashing signal is generated which, when the cross wound bobbin is approaching the predefined thread length, has an increasingly high frequency. A continuous light shows that the predefined thread length has been reached at this workstation and production is stopped.

A sensor system for a ring spinning machine for recognizing so called creeping spindles is described in German Patent Document DE 199 29 467 A1. The sensor is suitable for delivering a signal which can be evaluated both for the display of a break in the thread and for the display of a "creeping state" of the spindle assigned to the sensor. The sensor can cooperate with an evaluation device and a display means, wherein the display means indicates the presence of a creeping state. The display means is preferably provided in the vicinity of the spindle. For the sensor and the display means a common mount can be provided.

A further alternative for a machine producing a ring yarn or pre-yarn can be taken from German Patent Document DE 34 06 215 A1. In order to be able to assign an error message function to the load carriers of the drafting systems, the handles of the load carriers are designed as signal lights, i.e. the handle is a gripping knob containing a signal light, and is made at least partly from a transparent or translucent material.

In general, a textile machine with a plurality of similar workstations is disclosed in German Patent Document DE 199 30 714 A1. By arranging a display device at each workstation a separate display device is also assigned to each individual control device. Furthermore, the data are available at each relevant workstation so that the operating staff on servicing the relevant workstation can perform or initiate the necessary measures straight away.

By activating the button once or several times in succession a different status of several queryable states of the workstation can be triggered and/or another of several definable functions can be triggered and/or scrolling texts can be provided for running through.

The methods and devices known from the referenced documents have the disadvantage however, that the possible operating states, which can displayed to be clearly visible, are limited. If displays are used in the form of signal lights, usually three or four light sources are used behind colored glass which signal the different operating states by having a different flashing frequency or continuous light. In this way however, only a small number of operating states can be represented.

However if displays are used as the display means more operating states can be shown, but only the current operating state of a respective workstation is displayed to the operating staff via a direct query to the display. In this way the display can be located directly on the respective workstation or at the end of the machine on the textile machine own central control device.

SUMMARY OF THE INVENTION

In view of the aforementioned documents, the invention seeks to create a textile machine with a plurality of similar workstations which further optimises the support of the operating staff and displays very different operating states and/or makes the batch allocation clearly recognizable for the operating staff.

Toward this end, the invention provides a textile machine with a plurality of similar workstations, as well as display means and a central control device, wherein the display means are connected to the central control device and/or a workstation control device. According to the invention, the textile machine comprises a display means which is designed as an LED light bar, a section of the LED light bar is assigned respectively to a workstation, and the LED light bar displays the respectively produced yarn batch and/or operating states of the respective workstation. Advantageous configurations of the invention are the subject matter of additional features of the invention.

The advantages achieved by means of the invention are in particular that by means of an LED light bar an almost endless variety of options is possible. Not only can an LED display all of the colors of flashing frequencies, but an LED light bar is also suitable for displaying linear effects for example which are particularly noticeable.

Sections of the LED light bar are assigned respectively to the individual workstations, here on said sections a plurality of LEDs are arranged and the LEDs can be controlled individually or in groups. In this way it is possible to display at a workstation at the same time the batch allocation and one or more operating states, in that for example the first two LEDs are green to show the batch allocation and the remaining LEDs flash red to signal a break in the thread.

An LED light bar should be defined within the scope of this application as any possible LED variant, for example even OLEDs. Independently of the density of LEDs per length unit, there are flexible or rigid LED light sources arranged in one or more rows. Also according to the invention light conductors are included in this definition. For simplification purposes the term LED light bar is synonymous with possible alternatives within the scope of this application.

An LED light bar of this kind is highly visible for operating staff and can permanently display which workstations are producing the same yarn batch and/or which operating state/operating states exist at the respective workstations. The light signals of the display means differ so clearly from one another that the operating staff can identify from a distance which workstation belongs to which yarn batch for example.

As according to the invention the operating staff get information as quickly as possible they are thus in a position to take the necessary corrective action straight away.

Furthermore, in this way the operating staff can determine promptly without any additional effort an advantageous sequence for executing the pending tasks and are considerably supported by the optimisation of the routines, as it is possible to identify rapidly and clearly whether an operation is pending and which operation should be performed next at which workstation.

The minimization of movements resulting from an "intelligent" sequence results in a shortening of the downtime of the individual workstations and thus to an increase in the effectiveness of the multipoint textile machine.

By arranging an LED light bar the electronic input is also reduced and costs are reduced by minimizing the amount of cabling.

According to another feature of the invention, the LED light bar is positioned such that it can be visible over the whole length of the textile machine.

Depending on the type of textile machine different attachment options are possible which ensure that the LED light bar can be easily noticed by the operating staff and even from a distance.

On a winding machine for example it is advantageous to attach either in the lower area, for example on the frame edge in front of the cop transport system or even at a mid-height in front of the round magazine. By attaching to such an exposed point the advantage according to the invention is particularly effective in that the displays of the LED light bar can be recognized easily by operating staff and also from a distance.

The good visibility can be supported further by a possibly inclined arrangement of the LED light bar. If the LED light bar is arranged more in the upper section of the textile machine, it is advantageous if it is attached slightly obliquely downwards so that the displays of the LED light bar can be recognized laterally and from below over the whole length of the textile machine. Similarly, an obliquely upwardly attached LED light bar in the lower section of the textile machine has a positive influence on the visibility.

In an advantageous embodiment of the invention, the magazine pockets have a display means, which corresponds with the LED light bar of the textile machine.

Despite the generally high degree of automation in textile machines there is still a demand for designs in which some working processes have to be performed manually. For example, winding machines can either be connected in a textile machine combination directly to the transport system of an upstream textile machine producing spinning cops, or they comprise a so-called round magazine with a plurality of magazine pockets which are fitted by hand with the spinning cops to be rewound.

According to the invention such magazine pockets are also equipped with at least one LED or are illuminated so that they are marked in the same color which also displays the batch allocation of the workstation. It is thus easier for the operating staff to fit the workstation with the correct spinning cops.

In a preferred configuration of the invention, each workstation comprises a workstation control device, which is connected to the LED light bar and is thus set up so that it activates different displays on the LED light bar related to the yarn batch and dependent on the operating state.

In this way a plurality of batches can be produced at the same time on a textile machine with a plurality of similar workstations, and the workstations with identical activation display the same color for example. The number of workstations, which produce the same yarn batch can thus be controlled variably and as necessary.

The LED light bar is connected via a signal line to the workstation control devices and is controlled by the latter. Specific operating states are assigned specific colors or effects.

Preferably, the workstation control devices are connected via a bus to a superordinate central control device, by means of which the control data for the workstation control device is allocated.

This structure ensures for the whole textile machine with a plurality of similar workstations, that the central control unit controls the individual, local workstation control devices, as each individual workstation control device is connected to the central control unit. For the operating staff this means that all of the control data for the batches are entered in a fixed location, which is usually situated at the end of the textile machine.

In another advantageous embodiment, the workstation control devices are set up for the entry of the control data.

It can also be practical to enter the control data locally at the respective workstation into the workstation control device. Thus the volume of data to be transported between the central control unit and the local workstation control devices is minimized.

BRIEF DESCRIPTION OF THE DRAWINGS

The invention is explained in more detail in the following description with reference to the embodiments shown in the drawings.

DETAILED DESCRIPTION OF THE INVENTION

Figure 1:
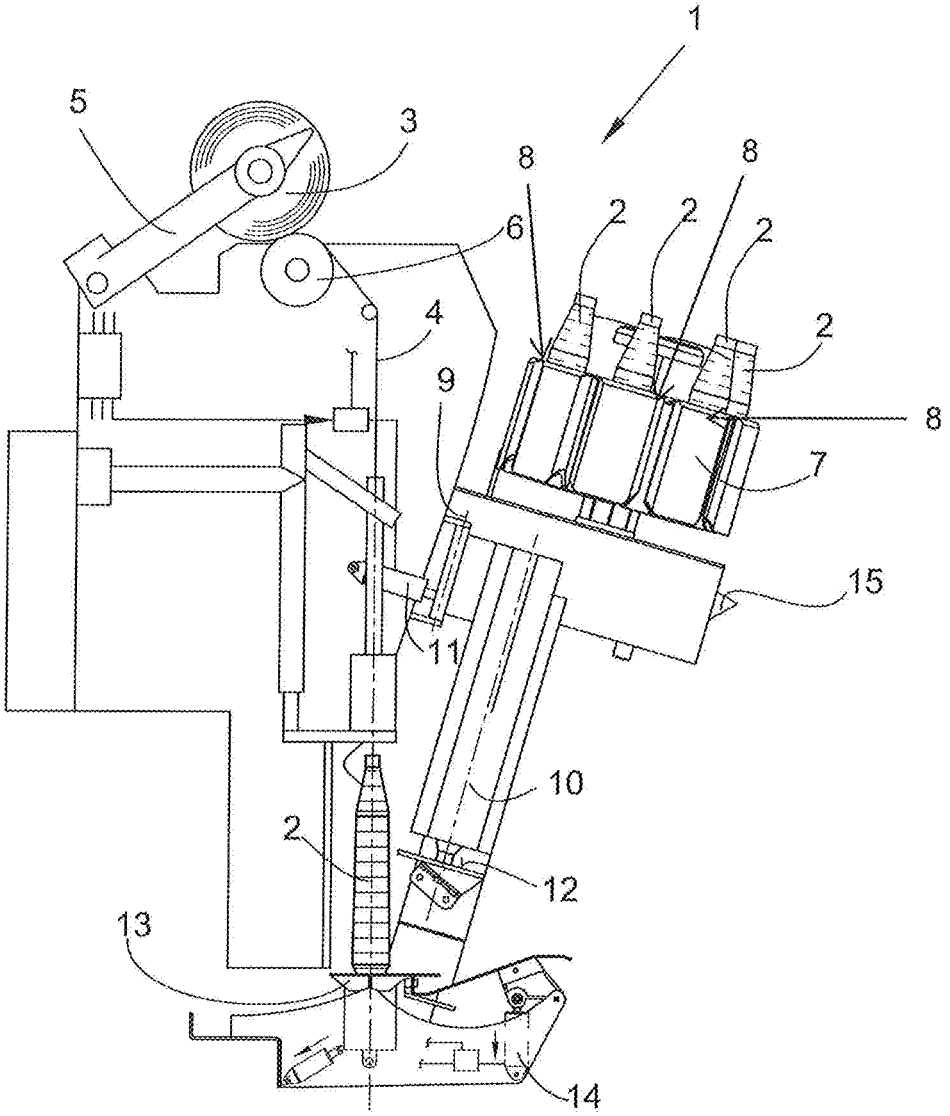
FIG. 1 shows a workstation of a winding machine in side view with a round magazine.
Figure 2:
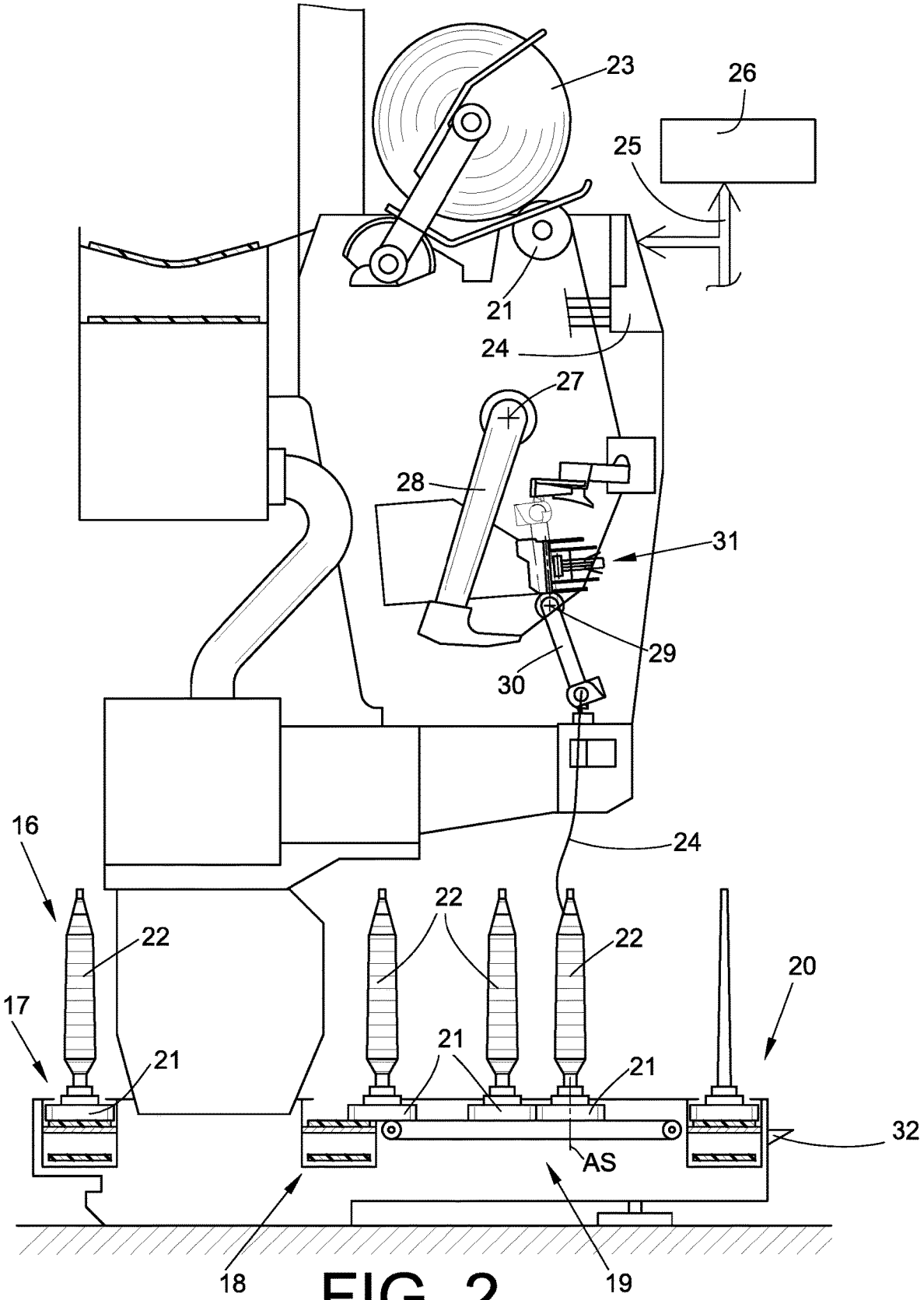
FIG. 2 shows a workstation of a winding machine in side view with a transport system.

FIGS. 1 and 2 show in perspective view one of the workstations 1 of a winding machine arranged in a row next to one another.

On such workstations 1 spinning cops 2 preferably produced on ring spinning machines, which comprise relatively little yarn material, are rewound into large volume cross wound bobbins 3, wherein the thread 4 is also monitored during the rewinding process for thread faults, which are removed if necessary.

The cross wound bobbins 3 are mounted freely rotatably respectively in a bobbin frame 5 during the winding process and are rotated during the winding process by a thread guiding drum 6, which also ensures that the thread 4 unwound from the spinning cop 2 is traversed correctly whilst running onto the cross wound bobbin 3.

Thread processing and monitoring devices are already known which are required in connection with the rewinding of such feed bobbins and the removal of thread faults and which are arranged on said workstations respectively in the region of the thread path. As said thread processing and monitoring devices are not relevant to the subject matter of the invention, said known devices are not represented and described in more detail.

As shown in FIG. 1 each of the workstations 2 has a rotatably mounted round magazine 7 for storing a plurality of spinning cops 2.

The round magazines 7 each comprise for example nine magazine pockets 8 for spinning cops 2. A loading shaft 10 is arranged underneath the round magazine 7 and is mounted with limited rotation about a pivot axis 9, which loading shaft can be positioned by means of a pneumatic cylinder 11 optionally in a position of rest or in a transfer position.

Also a stationary mount 12 is arranged underneath the ejection opening of the round magazine 7, on which mount an additional spinning cop 2 can be deposited prior to commencing the winding process or onto which a spinning cop 2 slides when it leaves the round magazine 7 through the ejection opening and is thereby secured by the loading shaft 10 positioned in a position of rest.

Each of the workstations 2 is also equipped with a pivotably mounted sleeve ejector 13, which can be positioned in a defined manner by means of a pneumatic cylinder 14.

The LED light bar 15 is positioned on the lower part of the round magazine 7 and is attached to be inclined slightly upwards.

In the embodiment of FIG. 2 the winding machine comprises an individual machine logistics device in the form of a cop and sleeve transport system 16, of which only the cop supply conveyor 17, the reversibly driven storage conveyor 18, one of the transverse transport conveyors 19 leading to the workstations and the tube return conveyor 20 are shown.

In said cop and sleeve transport system 16 spinning cops 22 or empty tubes rotate on transport plates 21 which are positioned in vertical alignment.

The supplied spinning cops 22 are thereby wound into large volume cross wound bobbins 23 in unwinding position AS, which is located respectively in the region of the transverse transport conveyors 19 at the workstations.

The individual workstations have for this purpose, as already known and therefore only indicated, various different devices which ensure the correct operation of said workstations. Said known devices are for example a workstation control device 24, which is connected via a bus line 25 to the central control device 26 of the winding machine, a suction nozzle 28 which moves about a pivot axis 27 and can be charged with negative pressure, a gripper tube 30 which moves about a pivot axis 29 and can be charged with negative pressure and a pneumatic thread splicing device 31.

The LED light bar 32 is advantageously attached inclined obliquely upwards onto the slightly upstream sleeve return conveyor 20 and is connected via a bus line 25 with both the workstations control devices 24 and the central control device 26. In the section of the LED light bar 32, which is assigned to the respective workstation, there are six individual LEDs. The first two LEDs indicate the batch allocation. In addition, the workstations 24 control the LED light bar 32 relative to the yarn batch so that the first two LEDs of the LED light bar 32 have an identical color at the workstations which are producing the same yarn batch. Batch 1 is identified by a yellow light and batch 2 by a blue light. The remaining four LEDs of the section are available for displaying operating states. If the lower thread is missing at this workstation and the workstation is idle, the LED light bar 32 is controlled so that the remaining LEDs flash red at a high frequency, so that the operating staff recognize that urgent steps need to be taken.

Figure 3:
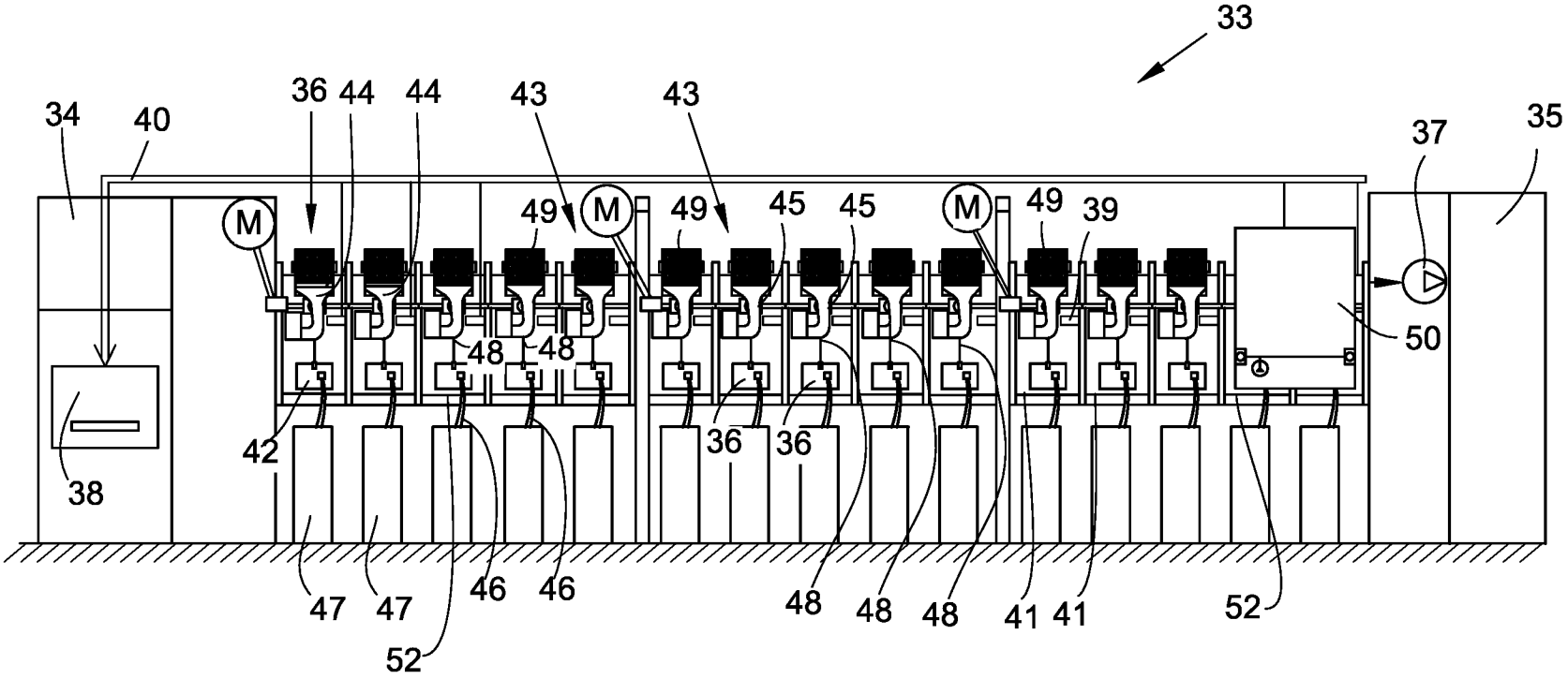
FIG. 3 shows in front view an open end rotor spinning machine with a plurality of workstations.

FIG. 3 shows schematically in front view an open end rotor spinning machine 33 with end frames 34, 35 and a plurality of similar workstations 36 arranged between the end frames 34, 35.

In the end frames 34 or 35, as is usual, there are for example a textile machine own source of negative pressure 37, an electric power supply and a central control unit 38 of the open end rotor spinning machine 33.

The central control unit 38 is connected in turn to the workstation control devices 39 of the individual workstations 36, preferably via a bus system 40.

The numerous workstations 36 each comprise a workstation housing 41 comprising an open end spinning device 42, a winding device 43, a suction nozzle 44 and additional known thread processing devices, such as for example a paraffining device 45.

In the lower section of the spinning devices 42 is the LED light bar 52, which is connected via a bus system 40 to the workstation control devices 39, wherein the workstation control devices 39 control the LED light bar 52 according to the yarn batch and operating state.

At the workstations 36 a feed fiber band 46 is spun into a thread 48 by means of the open end spinning device 42, which fiber band is stored in spinning cans 47 which are positioned in series next to one another below the workstations 36, and which thread is subsequently wound on the winding device 43 into a cross wound bobbin 49.

The open end rotor spinning machine 33 is also equipped with a cross wound bobbin exchanger 50 which can be driven along the workstations 36, which if necessary exchanges finished cross wound bobbins 49 for fresh cross wound bobbin tubes.

Figure 4:
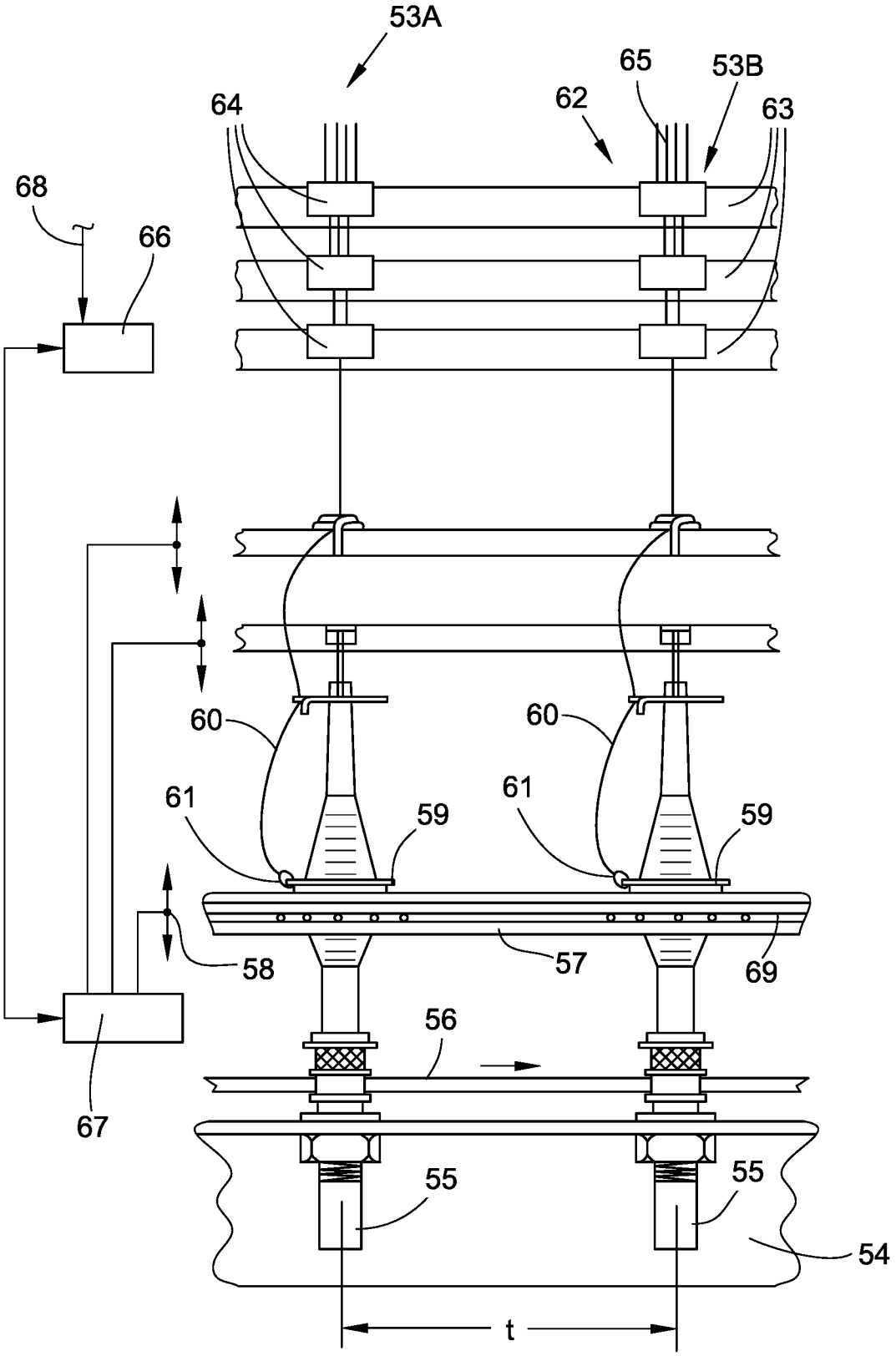
FIG. 4 shows a front view of two workstations of a ring spinning machine.

FIG. 4 shows schematically in front view two workstations of a ring spinning machine. The workstations are denoted here by the reference numerals 53A and 53B.

As already known, such ring spinning machines on each of their longitudinal machine sides have a stationary spindle rail 54, in which spinning spindles 55 are arranged at an interval t, which are driven in the embodiment by means of a tangential belt 56.

Above the stationary spindle rail 54 a vertically adjustable mounted ring rail 57 is arranged which, as indicated by arrow 58, can be moved by means of a (not shown in detail) drive mechanism according to a predefinable spinning program and is also provided with an LED light bar 69, which displays faults in the respective workstation 53A, 53B. Here five LEDs form the section, which is assigned to a workstation.

In the ring rail 57 spinning rings 59 are installed on which ring travellers 61 circulate during the spinning operation charged by the running thread 60.

The workstations 53A and 53B of the ring spinning machine are also equipped with a drafting system 62, between the lower rollers 63 and support rollers 64 of which the fiber band 65 to be spun is stretched, which preferably comes from a (not shown) roving bobbin which is suspended in an assigned creel.

As shown schematically in FIG. 4, the ring spinning machine also comprises an interface 66, which is connected to the control device 67 of the ring spinning machine, which controls the position of the winding of the spinning cops and the displays of the LED light bar 69. The connecting line is denoted by the reference numeral 68.

Figure 5:
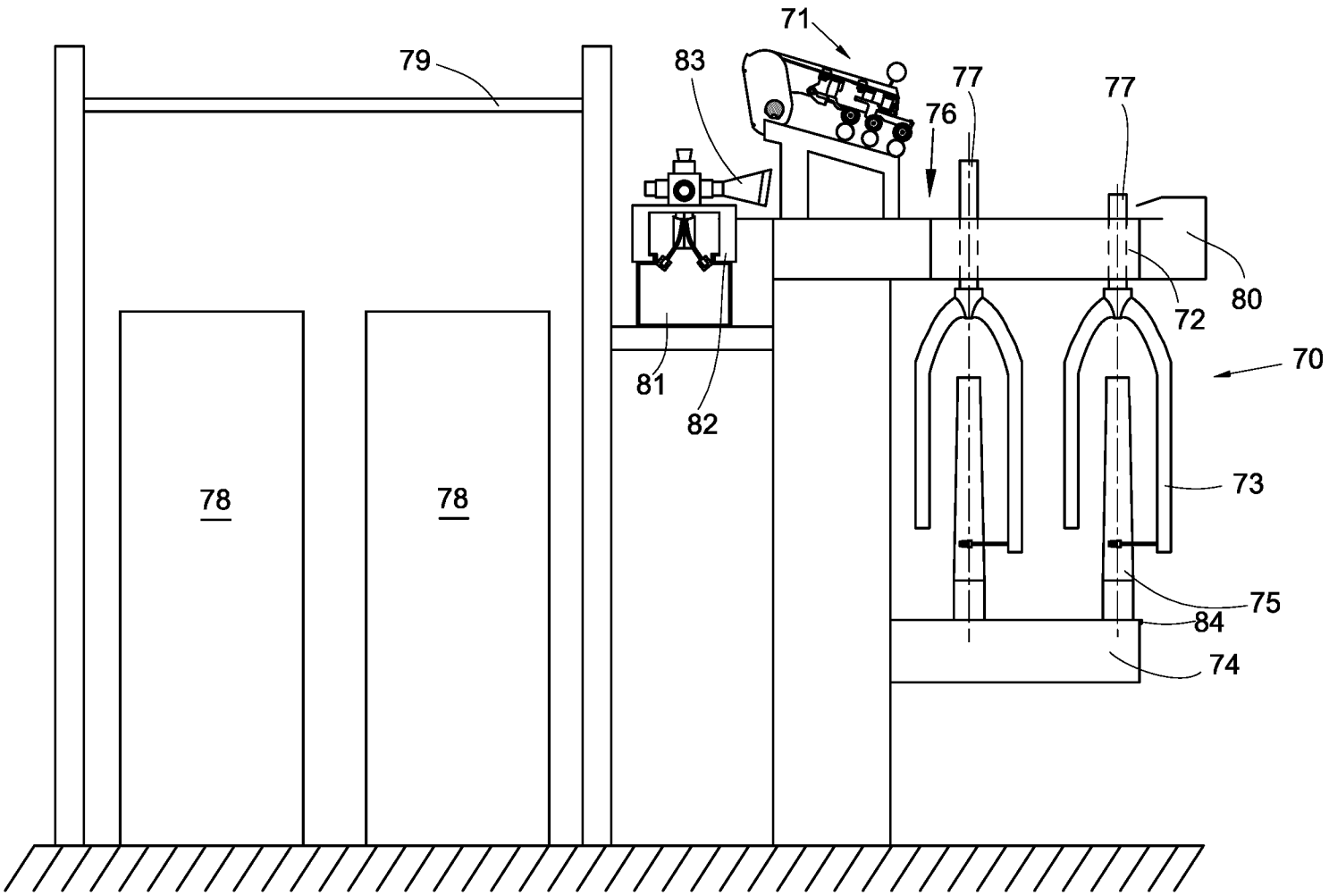
FIG. 5 shows a schematic side view of a prespinning machine.

FIG. 5 shows a prespinning machine 70, also known as a roving, with a drafting system 71, winged table 72, wings 73 and spindle rail 74 and spindles 75. FIG. 5 shows the side view and thus the transverse extension of the prespinning machine. Underneath the drafting system 71 there is an essentially flat surface 76. The surface 76 extends from the area of the drafting system 71 up to the wing units 77. On the spindle rail 74 an LED light bar 84 is attached such that sections of the LED light bar 84 can be assigned to the individual workstations of the prespinning machine 70.

In the spinning cans 78 there is a fiber roving. The fiber roving is guided over conveyor belts (not shown), which are secured to the support pipes 79, to the drafting system 71. The fiber roving runs through the drafting system 71 and is guided by the wing units 77 to the wings 73 and lastly wound onto not shown pre-yarn or roving bobbins which are arranged on the spindles 75. In longitudinal direction of the prespinning machine 70 a plurality of additional workstations are arranged.

On the front side of the winged table 72, i.e. on the side of the surface 76 facing the wing units 77, a blowing device 80 is arranged which charges the surface 76 in the area below the drafting system 71 or above the winged table 72 with blown air over the whole area.

On the opposite side, i.e. on the side facing the drafting system 71, a suction channel 81 extending in the longitudinal direction of the prespinning machine 70 is arranged. On the suction channel 81 a slide 82 is arranged with a suction opening 83 which moves along the suction channels 81 and removes impurities from the surface 76.

The present invention has been herein described in relation to an exemplary embodiment or embodiments for purposes of providing an enabling disclosure of the invention. However, it will be understood by persons skilled in the relevant art that the present invention is susceptible of a broader utility and application. Accordingly, it is to be expressly understood that the present invention is not to be construed as limited to the embodiments, features and aspects herein described, but only according to the appended claims.

What is claimed is:

1. A textile machine comprising:

a plurality of similar workstations, a display, and a central control device, wherein the display is connected to the central control device, and wherein, the textile machine comprises a length including the display which is designed as an LED light bar, a section of the LED light bar is assigned respectively to a workstation, and the LED light bar configured to display a respectively produced yarn batch and an operating state of the workstation, and wherein the LED light bar is capable of making a batch allocation recognizable at the same time for every individual workstation of the plurality of similar workstations.

2. The textile machine according to claim 1, wherein the LED light bar is positioned such that it is visible over the length of the textile machine.

3. The textile machine according to claim 1, wherein magazine pockets comprise the display, which corresponds with the LED light bar of the textile machine.

4. The textile machine according to claim 1, wherein each workstation comprises a workstation control device which is connected to the LED light bar and is set up so that it triggers different displays on the LED light bar which are related to the yarn batch and are dependent on the operating state.

5. The textile machine according to claim 1, wherein the workstation control devices are connected via a bus to a superordinate central control device, by which the entry and/or allocation of the control data is performed for the control devices of the respective groups.

6. The textile machine according to claim 1, wherein the workstation control devices are set up for the entry of control data.

* * * * *